US009267342B2

(12) United States Patent
Hilton

(10) Patent No.: US 9,267,342 B2
(45) Date of Patent: Feb. 23, 2016

(54) PIPE HANDLING APPARATUS AND METHOD

(71) Applicant: WARRIOR ENERGY SERVICES CORPORATION, Houston, TX (US)

(72) Inventor: Thomas Dale Hilton, Laurel, MS (US)

(73) Assignee: WARRIOR ENERGY SERVICES CORPORATION, Houston, TX (US)

( * ) Notice: Subject to any disclaimer, the term of this patent is extended or adjusted under 35 U.S.C. 154(b) by 225 days.

(21) Appl. No.: 13/660,784

(22) Filed: Oct. 25, 2012

(65) Prior Publication Data

US 2014/0119855 A1 May 1, 2014

Related U.S. Application Data

(63) Continuation-in-part of application No. 13/523,238, filed on Jun. 14, 2012, now Pat. No. 8,899,901.

(51) Int. Cl.
*E21B 19/15* (2006.01)

(52) U.S. Cl.
CPC ..... *E21B 19/15* (2013.01)

(58) Field of Classification Search
CPC ..... E21B 19/14; E21B 19/00; E21B 19/15; E21B 19/155; B21D 43/006; B21D 43/285
USPC ..... 414/22.51–22.71, 745.1, 745.9, 746.1, 414/746.2, 746.4; 175/52; 198/468.6, 198/861.5; 254/133 R, 88, 8 R, 9 C, 9 R; 312/42
See application file for complete search history.

(56) References Cited

U.S. PATENT DOCUMENTS

| | | | | |
|---|---|---|---|---|
| 2,113,270 | A * | 4/1938 | Hall et al. | 414/22.57 |
| 2,922,533 | A * | 1/1960 | La Barge, Jr. | 414/746.7 |
| 3,785,506 | A | 1/1974 | Crocker et al. | |
| 3,810,553 | A | 5/1974 | Crocker et al. | |
| 4,403,898 | A | 9/1983 | Thompson | |
| 4,470,740 | A * | 9/1984 | Frias | 414/22.61 |
| 4,486,137 | A * | 12/1984 | Buckner | 414/22.61 |
| 4,643,273 | A | 2/1987 | Stokoe | |
| 4,684,314 | A | 8/1987 | Luth | |
| 5,249,642 | A | 10/1993 | Kishi | |
| 6,079,925 | A * | 6/2000 | Morgan et al. | 414/22.57 |
| 6,390,762 | B1 | 5/2002 | Peery et al. | |
| 6,488,161 | B1 | 12/2002 | Bean | |
| 6,547,034 | B1 | 4/2003 | Waters | |
| 7,021,880 | B2 * | 4/2006 | Morelli et al. | 414/22.59 |
| 7,246,684 | B2 | 7/2007 | Bean | |
| 7,404,697 | B2 | 7/2008 | Thompson | |
| 7,614,492 | B2 * | 11/2009 | Muse et al. | 198/468.6 |
| 7,635,249 | B2 | 12/2009 | Guidroz | |
| 7,665,944 | B2 | 2/2010 | Guidroz | |
| 7,832,974 | B2 | 11/2010 | Fikowski et al. | |

(Continued)

*Primary Examiner* — Saul Rodriguez
*Assistant Examiner* — Lynn Schwenning
(74) *Attorney, Agent, or Firm* — Winston & Strawn LLP

(57) ABSTRACT

Equipment for moving tubular members from a storage rack to an elevated platform floor and back to the storage rack is disclosed. A base-mounted articulated support structure has a pipe trough mounted on top thereof. The support structure elevates the trough using a pair of struts and a plurality of articulated lifting arms mounted between the base and the support structure. Loading arms are secured to a side of the pivotal trough for picking up one tubular member from the rack and moving to the platform floor. Unloading arms detachably securable to the trough facilitate movement of the tubular members from the platform floor onto the rack.

41 Claims, 8 Drawing Sheets

(56) References Cited

U.S. PATENT DOCUMENTS

| | | | | |
|---|---|---|---|---|
| 7,883,309 | B2 * | 2/2011 | Smith et al. | 414/22.55 |
| 8,016,536 | B2 | 9/2011 | Gerber et al. | |
| 8,157,495 | B1 | 4/2012 | Randall | |
| 2008/0138174 | A1 * | 6/2008 | Hawkins | 414/22.54 |
| 2009/0053013 | A1 | 2/2009 | Maltby | |
| 2009/0252576 | A1 | 10/2009 | Gerber et al. | |
| 2010/0111646 | A1 | 5/2010 | Smith et al. | |
| 2010/0135750 | A1 | 6/2010 | Tarique | |
| 2011/0188973 | A1 * | 8/2011 | Baumler | 414/22.57 |
| 2013/0336747 | A1 | 12/2013 | Hilton | |
| 2013/0336748 | A1 * | 12/2013 | Hilton | 414/22.62 |

* cited by examiner

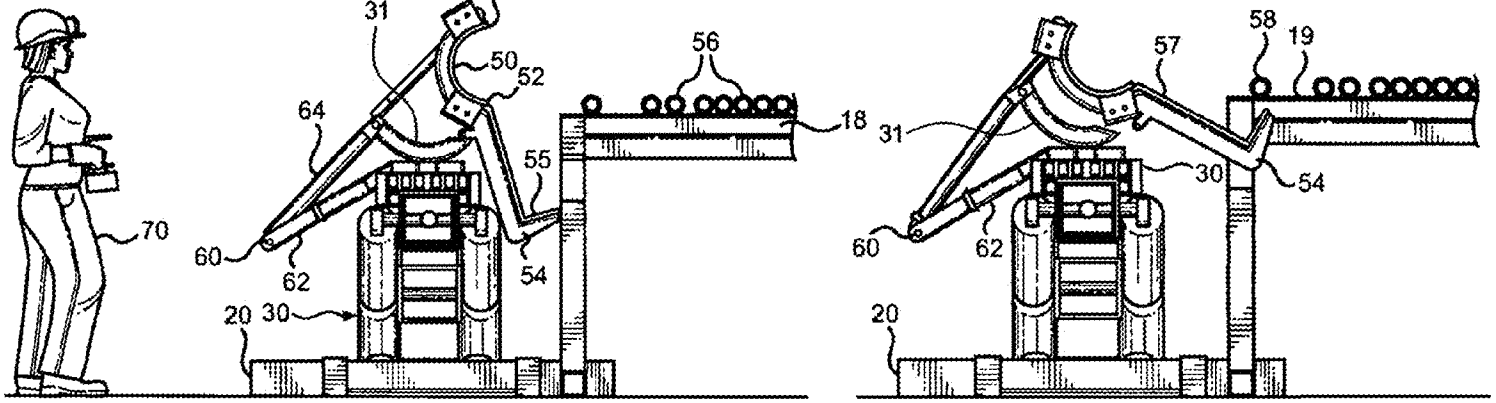
FIG. 8
FIG. 7
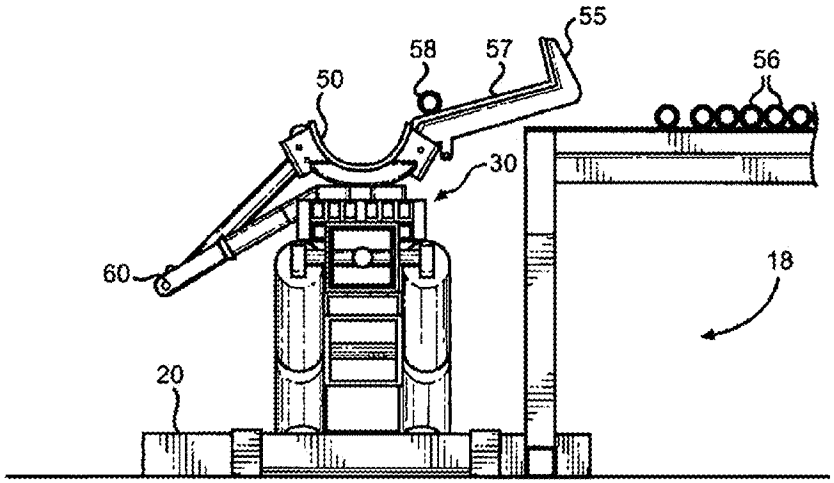
FIG. 9

PIPE HANDLING APPARATUS AND METHOD

CROSS-REFERENCE TO RELATED APPLICATIONS

This application is a continuation-in-part of my co-pending application Ser. No. 13/523,238 filed on Jun. 14, 2012 entitled "Pipe Handling Apparatus and Method," the full disclosure of which is incorporated by reference herein and priority of which is hereby claimed.

BACKGROUND OF THE INVENTION

This invention relates to oil and gas industry and, more particularly to an apparatus for moving elongated tubular members between a rack and a rig floor.

During drilling and completion operations, it is necessary to make up and/or break down long strings of tubular members such as drill pipe and casing. The string of pipe may be thousands of feet long, and it is therefore necessary to transport pipe joints, which can be up to 32 feet long, from a pipe rack located away from the rig up to the rig floor. When the drill string is tripped out of the hole, the string of pipe is broken down into separate joints and returned to the pipe rack. The drilling platform is usually at some distance from the pipe rack and is elevated above the ground by 15-20 feet.

The handling of oil well pipe is one of the most dangerous jobs on a drilling rig. Some of the pipe joints weigh thousands of pounds, and it is difficult to move the pipe from a horizontal position on the pipe rack into a vertical position overlying the borehole in the rig. The industry has developed various types of equipment to assist in transporting the pipe segments from the pipe rack to the platform and back to the pipe rack. Conventional pipe handling machines use a trailer, a carriage mounted on the trailer and a trough, which is supported by the carriage. The operators load one pipe segment at a time into the trough from the pipe rack. A lift arm moves the carriage to elevate one end of the trough to a platform floor, where rig operators use pick up arms to slide the pipe segment from the trough and lower the pipe segment into the borehole.

Even though part of the pipe handling process is assisted by the elevating carriage, the operators still need to manually lift the pipe segment from a horizontal pipe rack and carefully place it in the trough of the pipe handling machine. It is important to note that the exterior of the pipe segments has a protective anti-corrosive coating, which can be damaged if the pipe segment is dropped or scraped against an edge of the trough. In conventional equipment, the trough is affixed to the elevating arms and does not pivot or tilt.

U.S. Pat. No. 7,665,944 teaches a pipe handling method, which uses a longitudinally extending base frame assembly having a system of base rails or tracks, a movable carriage having a carriage frame and roller assembly for supporting the movable carriage on the frame base rails, and a pipe lifting structure that is mounted to this movable carriage. The carriage, and consequently the pipe lifting structure, is configured so that it may be moved as desired along the length of the base frame by means of the carriage rollers and base rail system to facilitate a desired lifting sequence. The pipe lifting structure has a semicircular pipe support trough that is supported by hydraulically driven telescopically extendable lifting arm assembles. The base end of each telescopically extendable lifting arm assembly is pivotally mounted to the carriage. The trough end of each lifting arm assembly is pivotally mounted to a lifting structure stabilizer frame that extends longitudinally between each lifting arm assembly.

While the method of U.S. Pat. No. 7,665,944 may work satisfactory in many circumstances, there remains a need for a pipe handling machine that would facilitate movement of the pipe segments from the pipe rack into the trough and back in an efficient and safe manner.

The present invention contemplates elimination of drawbacks associated with conventional methods and provision of a pipe handling apparatus and method that assists in moving pipe segments from and to the pipe rack.

SUMMARY OF THE INVENTION

It is, therefore, an object of the present invention to provide an improved pipe handling apparatus and method for use in oil and gas industry.

It is another object of the present invention to provide a pipe handling apparatus and method that facilitates movement of elongated tubular member, such as pipe segments, from a horizontal rack to platform floor and back to the pipe rack.

These and other objects of the invention are achieved through a provision of an apparatus and method for moving a tubular member between a storage rack and an elevated floor of a platform. The apparatus has an articulated support structure mounted on a base and carrying a semi-cylindrical pivotal trough on top thereof. Loading arms secured to the trough move to pick up a pipe from the storage rack when the trough is tilted towards the storage rack. When the support structure is elevated it moves the trough with the tubular member towards the platform floor. The support structure also articulates to move the tubular strands from the rig floor to the storage rack.

Unloading arms are detachably securable to the trough as well. The support structure having a tubular member deposited into the trough at the platform floor is lowered and causes pivotal movement of the trough. The unloading arms guide the tubular member from the pipe trough onto the storage rack.

The support structure uses a pair of struts and a plurality of lifting arms mounted between the base and the support structure for elevating the pipe trough and moving the pipe trough along the support structure to a floor of a drilling/production platform.

BRIEF DESCRIPTION OF THE DRAWINGS

Reference will now be made to the drawings, wherein like parts are designated by like numerals, and wherein

FIG. 7 is a detail side view illustrating the loading arm positioned for engaging a tubular member.

FIG. 8 is a plan view illustrating the loading arm pivoted to guide the pipe segment into the pipe trough.

FIG. 9 illustrates the trough being rotated while picking up the tubular member.

DETAIL DESCRIPTION OF THE INVENTION

Figure 1:
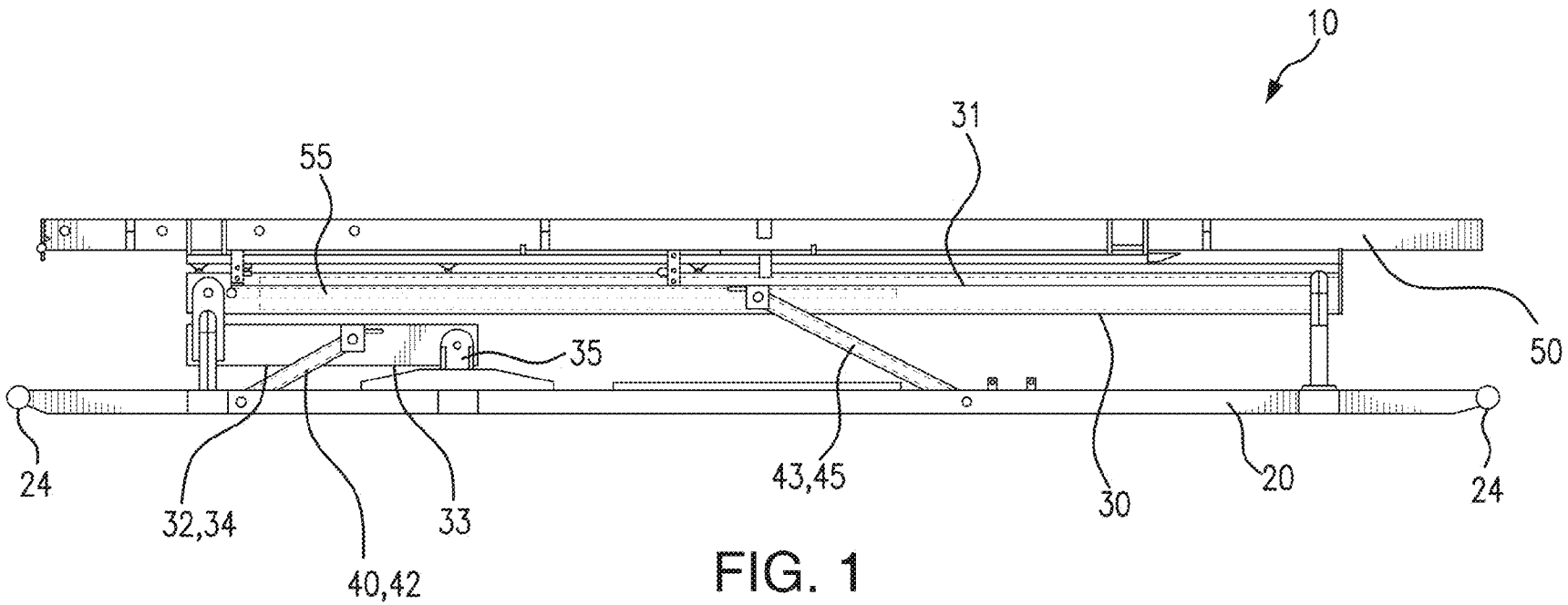
FIG. 1 is a side view of the pipe handling apparatus according to the present invention, with the pipe trough support in a folded position.
Figure 2:
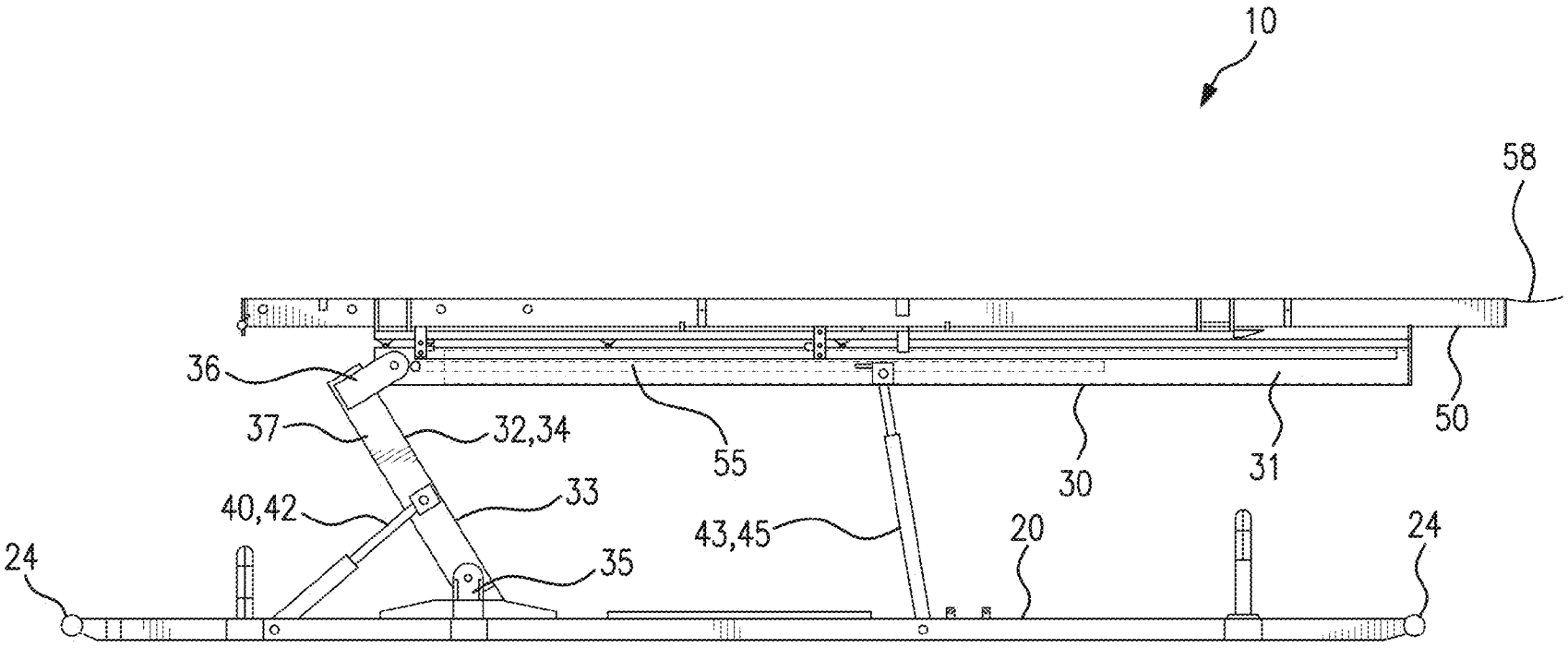
FIG. 2 is a side view of the pipe handling apparatus according to the present invention, with the pipe trough support in a pipe loading/unloading position.

Turning now to the drawings in more detail, numeral 10 designates the pipe handling apparatus according to this invention. The apparatus 10 can be delivered to a work site in any available manner, for instance a trailer, a truck, or other transportation means. The trailer can be attached to a towing vehicle and transported to the designated location, such as a site of a drilling rig.

The apparatus 10 comprises a base, such as a skid 20, which supports the apparatus 10 in a longitudinal position during transport. The base 20 can be formed as a frame composed of a pair of parallel rails 21, 22 and a plurality of transverse bars 23 extending between the opposing rails 21, 22. The frame or base 20 can be positioned on the ground adjacent a storage rack 18 and the drilling rig and moved to a pre-selected position using rotating rollers or wheels 24 secured to ends of the elongated rails 21, 22. The rear portions of the rails 21, 22 are designated by numerals 25 and 26, respectively, while the forward ends of the rails 21, 22 are designated by numerals 27, 28, respectively.

The present invention is adaptable to various lengths of tubulars. The tubulars are used in wellbore and derrick operations, such as casing, tubing, drill pipe or stands of pipe that need to be moved from one location to another at the wellbore operations.

The pipe handling apparatus 10 also comprises an articulated support structure 30, which moves between a folded position shown in FIG. 1, to a plurality of extended positions shown in FIGS. 2-5, as will be described in more detail hereinafter. The support structure 30 is connected to the base 20 by elongated spaced-apart parallel struts 32, 34 having a bottom end pivotally supported by the base 20 and having upper ends pivotally supporting the support structure 30. The struts 32, 34 are mounted on opposite sides of the support structure 30.

A lower end 33 of each strut 32, 34 is pivotally engaged with a bracket 35 affixed to the base 20. An upper end 37 of each strut 32, 34 carries a transverse portion 36 oriented at a right angle in relation to a longitudinal axis of the strut 32, 34. A free end of the transverse portion 36 is pivotally connected to an elongated beam 31, which forms a part of the support structure 30. Each of the struts 32, 34 has an inverted L-shaped configuration. In the extended position, the struts 32, 34 are oriented at an acute angle in relation to the support structure 30 and at an obtuse angle in relation to the base 20.

The apparatus 10 comprises a system of hydraulically movable lifting arms or cylinders, which move the support structure 30 between a folded position and unfolded upwardly extending positions. The first pair of spaced-apart parallel lifting arms 40, 42 is positioned between the base 20 and the elongated struts 32, 34, with an upper end of each of the lifting arms 40, 42 being secured to the struts 32, 34 at about mid-point of the length thereof. The lifting arms 40, 42, similarly to the struts 32, 34 are positioned on opposite sides of the support structure 30.

A second pair of spaced-apart lifting arms 43, 45 is mounted forwardly in relation to the first pair of lifting arms 40, 42 and of the struts 32, 34. The second pair of lifting arms 43, 45 can be mounted approximately midway along the length of the support structure 30. Each of the second pair of lifting arms has a lower end pivotally secured to the base 20 and an upper end pivotally engaging the elongated support beam 31. Similar to the lifting arms 32, 34, the lifting arms 43, 45 are mounted on opposite sides of the support structure 30. Each of the lifting arms 40, 42, 43, and 45 comprises telescopically extendable rods that can be extended and retracted hydraulically or using other suitable power source in relation to their respective pistons.

The support beam 31 pivotally supports an elongated pipe tray or trough 50, which can be formed as a semicylindrical body having longitudinal dimensions approximating longitudinal dimensions of tubulars to be handled by the apparatus 10. In one aspect of the invention, a longitudinal axis of the trough 50 extends substantially parallel to a longitudinal axis of the support beam 31 when the trough 50 is in a storage position shown in FIG. 1. The trough 50 slidably moves along the support beam 31 using a sliding assembly 55 mounted adjacent a proximate end 38 of the support beam 31.

Figure 3:
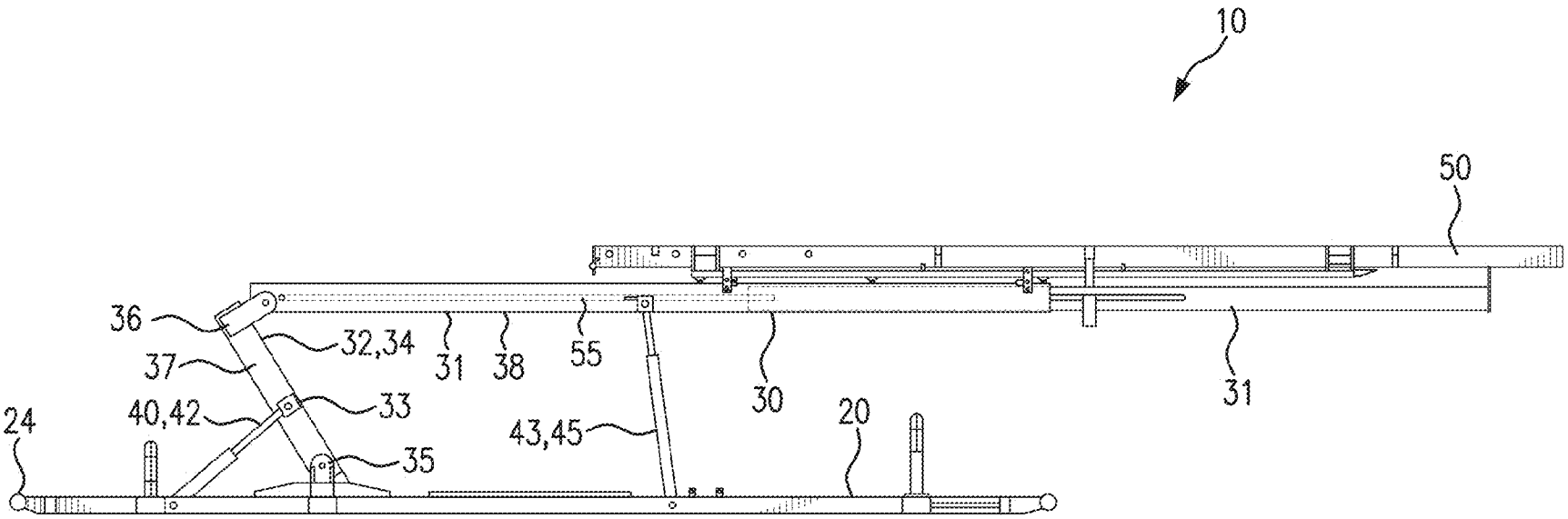
FIG. 3 is a side view of the pipe handling apparatus according to the present invention, with the pipe trough advanced along the supporting beam.
Figure 4:
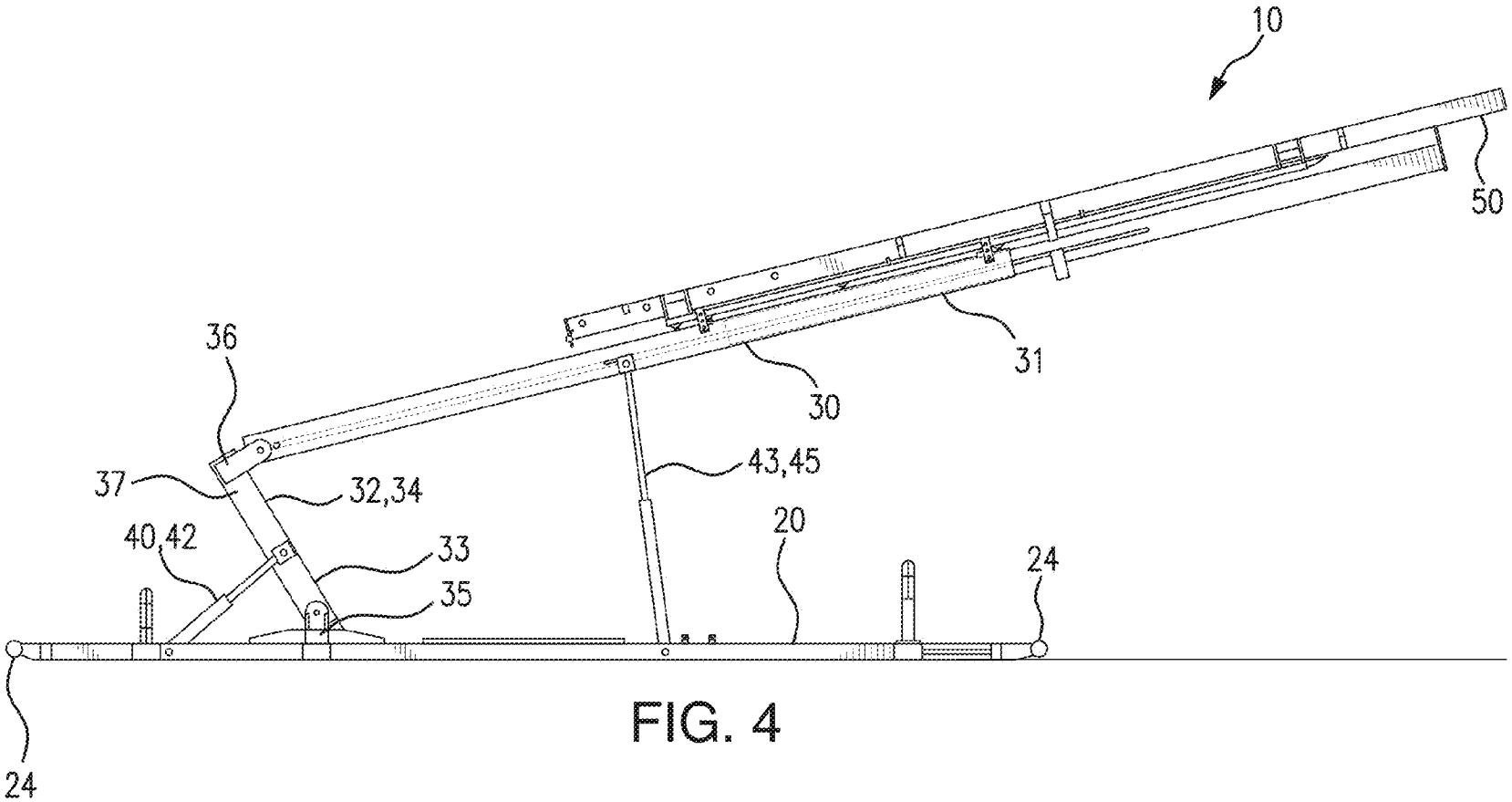
FIG. 4 is a side view illustrating the pipe handling apparatus with the elevated pipe trough in an inclined position.

The sliding assembly 55 comprises an extendable arm, which can be formed by a hydraulic cylinder pushing the trough 50 forward along the support beam 31 during delivery of a tubular strand 58 to the rig floor. Such forwardly extended positions of the trough are illustrated in FIGS. 3 and 4. When retracted, the sliding assembly 55 allows the trough 50 to return to its original position shown in FIGS. 1 and 5. The sliding assembly 55 also acts as a stop preventing the tubular strand 58 from sliding down along the trough 50.

The pipe tray or trough 50 comprises parallel side edges 51, 52 extending along the length of the semicylindrical body. Two or more spaced-apart loading arms 54 are secured to the trough 50 adjacent the edge 52. For convenience, the edge 52 will be considered the right edge of the trough 52 when seen in the detail side views of FIGS. 7-9. Of course, depending on the location of the storage rack 18 of the tubulars 56, the loading arms 54 can be secured adjacent the left edge 51. The loading arms 54 have a generally L-shaped configuration with a first shorter part 55 and a second longer part 57.

The trough 50 can tilt in relation to the support beam 31 between a storage position shown in FIG. 9 and loading positions shown in FIGS. 7 and 8. Articulated pivot assemblies 60 move the trough 50 between loading and unloading positions. The articulated pivot assemblies 60 comprise a first elongated bar 62 coupled to the support structure 30 and telescopically extendable second bar 64 pivotally connected to a free end of the first bar 62. The second bar 64 can be hydraulically operated.

During a loading operation, the apparatus 10 is positioned adjacent the storage rack 18, which stores a plurality of tubular members or tubulars 56 in a horizontal position. An operator 70 activates the power source, such as a hydraulic motor (not shown) to raise the support structure 30 by raising the struts 32, 34 using the lifting arms 40, 42, and 43, 45. The trough 50 is positioned in general vertical alignment with the storage rack 18. Another worker may assist in urging the tubular member towards an edge of the rack 18.

The operator 70 then causes the trough 50 to pivot from a stationary position shown in FIG. 9 to positions shown in FIGS. 7 and 8. The loading arms 54 move below the surface 19 of the storage rack 18, on which the tubulars 56 are positioned. First, the trough 50 is tilted at 45 degrees, as shown in FIG. 7, and the loading arms pick up the forwardmost tubular strand 58. The trough 50 is then rotated back to the starting position, as shown in an intermediate step in FIG. 8, allowing the tubular strand 58 to roll into the trough 50.

Since the second part 57 of the loading arm 54 is oriented at an obtuse angle in relation to the edge 52 and extends somewhat upwardly from the edge 52, the tubular strand 58 rolls along the second part 57 of the loading arm 54 into the trough 50. If desired, the contact surfaces of the loading arms 54 can be coated with non-abrasive coating so as not to damage exterior of the tubular 56. As the trough 50 returns to the starting position illustrated in FIG. 9, the tubular strand 58 remains in the trough.

Figure 5:
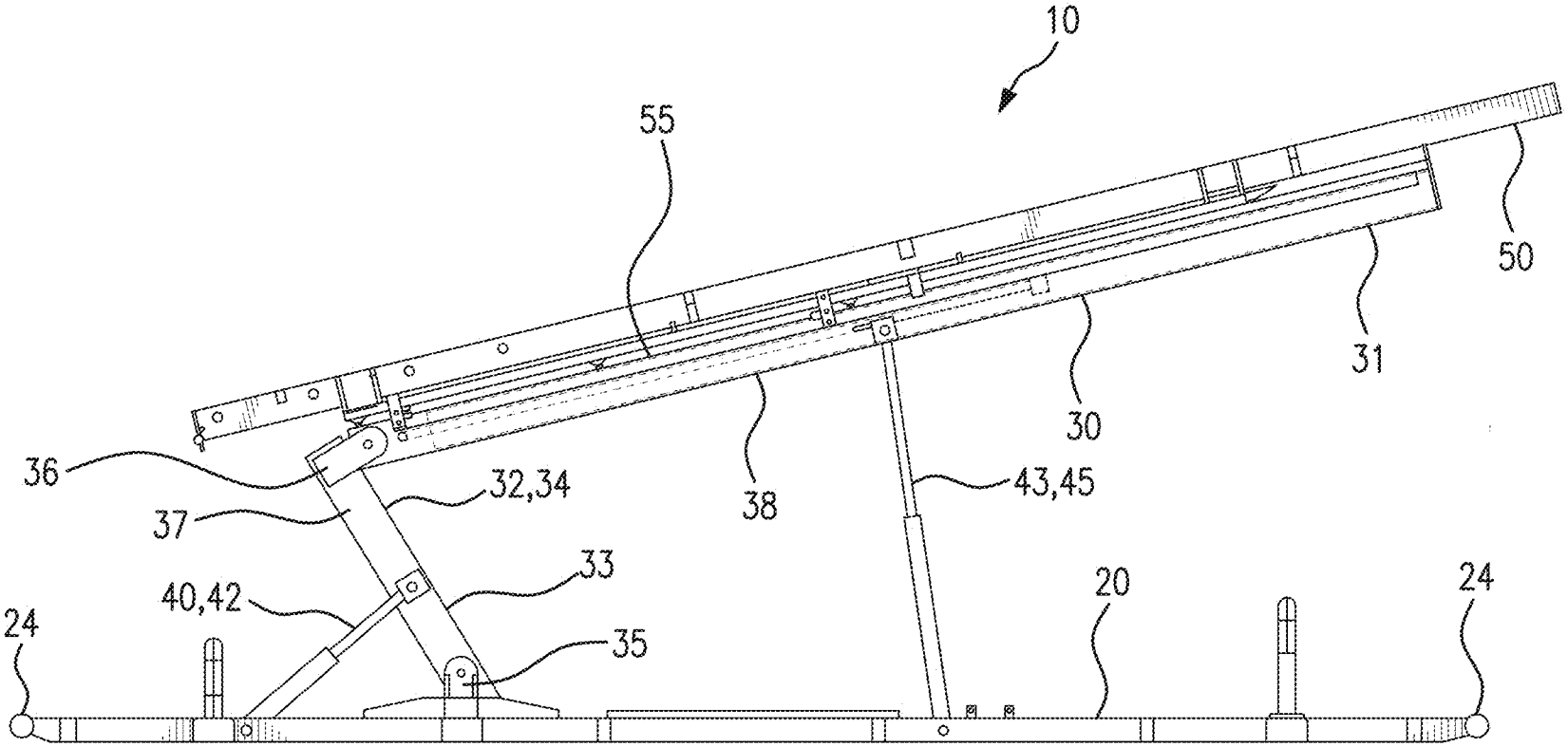
FIG. 5 is a side view illustrating the pipe handling apparatus with the elevated pipe trough in an inclined and retracted back position.
Figure 6:
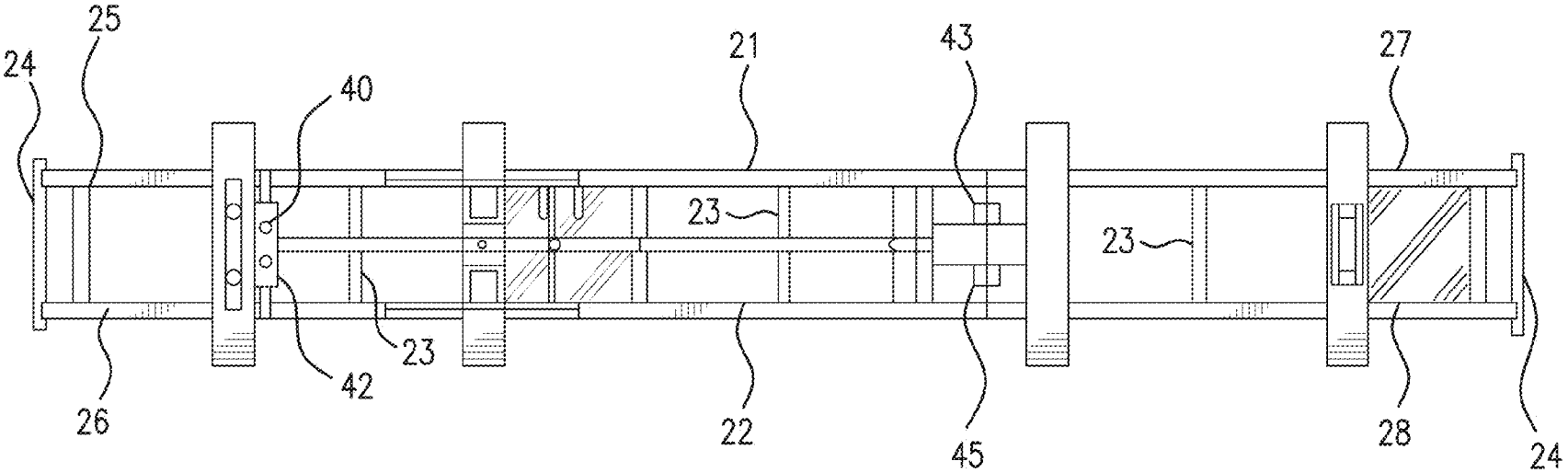
FIG. 6 is a plan view of the pipe handling apparatus of the present invention.

Referring now to FIGS. 3-5, the process of delivering the tubular strand 58 to the rig floor will be explained. Starting from the stationary position shown in FIG. 2, the operator activates the sliding assembly 55 to move the pipe tray 50 forward in relation to the support structure 30. The pipe tray 50 is shown in generally horizontal position in FIG. 3, with the support structure 30 extending substantially parallel to the base 20.

The operator 70 then activates the lifting arms 43 and 45 causing the forward end 37 of the support structure 30 to be gradually elevated. FIG. 4 shows the forward end 47 raised to extend at an obtuse angle in relation to the lifting arms 43, 46 and about 45-degree angle in relation to the base 20. The trough 50 carrying a tubular strand 58 is shown oriented at an angle above the base 20.

FIG. 4 illustrates position of the pipe trough 50 after the sliding assembly 50 has been activated to move the trough 50 forward so as to extend a forward end of the pipe trough toward the floor of the drilling rig (not shown). In this position, the platform workers can use gripping tools to remove the tubular strand 58 from the pipe trough 50.

Once the tubular strand 58 is unloaded to the platform, the operator 70 activates the power source again, retracting the siding assembly 55 and the pipe trough 50 along the support beam 31 to a position shown in FIG. 5. Gradually, the support structure 30 is returned to the starting loading position shown in FIG. 3. The process of loading the tubulars into the trough and moving the tubulars to the platform is repeated several times until all required tubular strands have been incorporated into the job.

The apparatus of the present invention also provides a means for unloading the tubulars when they are no longer required on the rig and depositing them onto the storage rack 18. To facilitate the unloading process, the apparatus 10 is provided with a plurality of unloading arms 72 secured adjacent the edge 51 of the trough 50. It will be understood that the positioning of the loading arms 54 and the unloading arms 72 relative to the edges of the trough 50 can be easily reversed since both the loading arms 54 and the unloading arms 72 are detachably engaged with the trough 50.

Figure 11:
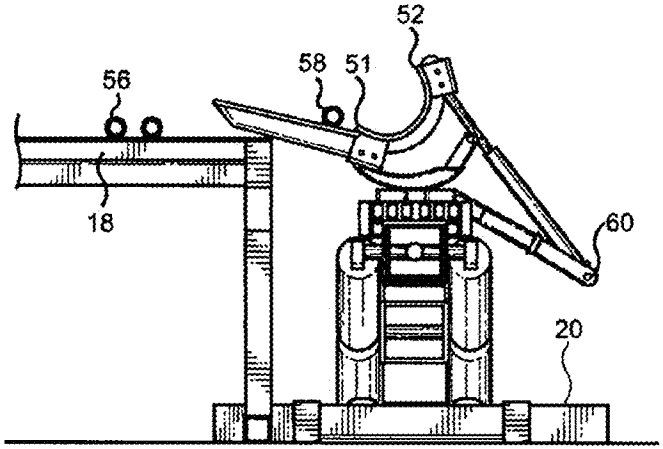
FIG. 11 is a detail side view illustrating the tilted trough with a pipe moving along the unloading arm.
Figure 10:
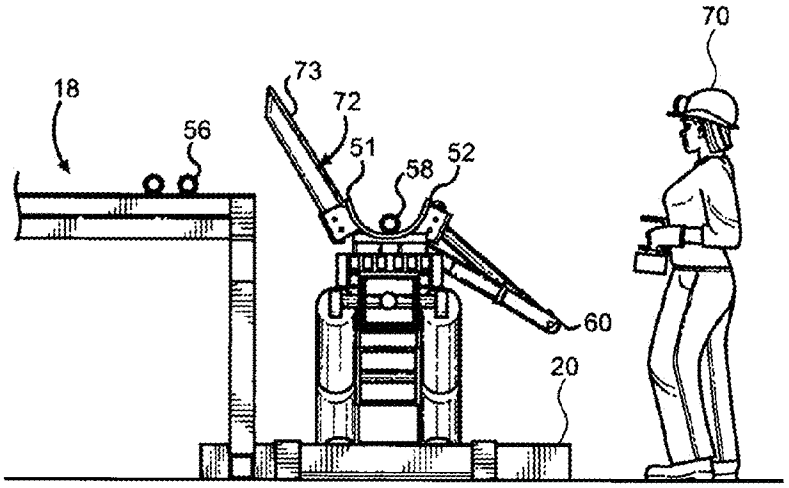
FIG. 10 is a detail side view illustrating the trough with a pipe segment ready to be unloaded.
Figure 12:
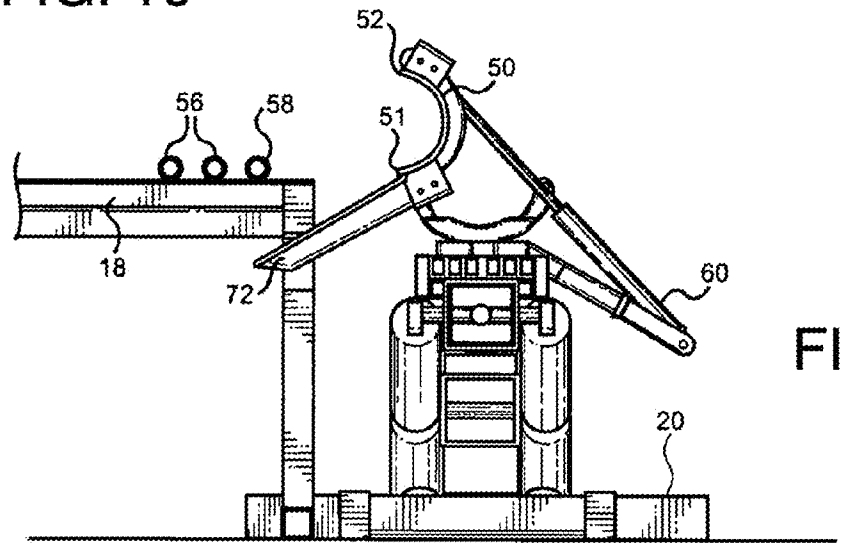
FIG. 12 is a detail side view illustrating the tilted trough with the unloaded pipe segment.

As illustrated in FIGS. 10-12, the articulate pivot assemblies 60 are now located on the "right" side of the trough 50. This arrangement is easily achieved by orienting the base 20 of the apparatus 10 such that the unloading arms 72 face the storage rack 18. In the illustration of FIGS. 10-12, the unloading arms extend from the "left" side of the trough 50.

Each of the unloading arms 72 comprises a generally planar upper surface 73 which can be covered with a protective coating so as to avoid damage to the tubular exterior. Each of the unloading arms 72 is oriented to extend at a tangent to a side of the arcuate trough 50 adjacent either edge 51 or 52. In this exemplary illustration, the unloading arms 72 are detachably secured to the underside of the trough 50 and extend upwardly in relation to the edge 51.

When the drill string (or other lengths of tubular) is removed from a wellbore and is broken, it presents itself as a plurality of tubular strands that are usually stacked on the rack 18. As shown in FIG. 10, the rack 18 is ready to receive the tubular strands 56. The apparatus 10 is again positioned adjacent the rack 18 which is maneuvered to be close enough to the rig and capable of moving between a fully extended position shown in FIG. 5 to a loading/unloading position shown in FIG. 2.

The tubular strand 58 deposited into the trough 50 at the platform floor is lowered to the rack 18, as shown in FIG. 11. The operator 70 activates the pivot assemblies 60 to tilt the trough first to a position shown in FIG. 10, at about 45 degrees in relation to the base 20 in order to begin unloading of the tubular 58. Since the upper surface 73 of the unloading arm 72 forms an extension of the edge 51, the tubular strand 58 is allowed to roll along the upper surface 73. Further tilting of the trough 51 by the pivot assemblies 60 causes the unloading arm 72 to a position shown in FIG. 11, and then to 90 degrees in relation to the base 20. The tubular strand 58 thus rolls under gravity onto the rack 18 as shown in FIG. 12. The process of bringing the tubular strands from the rig continues until all tubulars are properly stored.

It is envisioned that the power source for operating the apparatus of the present invention can be pneumatics or geared electric motor. The use of loading and unloading arms allows reduction of the number of workers operating the pipe handling apparatus, thus substantially reducing the cost of the operation.

Many changes and modifications can be made in the apparatus and method of the present invention. I, therefore, pray that my rights to the present invention be limited only by the scope of the appended claims.

I claim:

1. An apparatus for moving a tubular member, comprising:

a base configured to be positioned adjacent a storage rack containing a plurality of tubular members;

an articulated support structure mounted on the base and movable between a folded stationary position and a fully extended position, the support structure comprising:

an elongated support beam having a proximate end and a distant forward end, and a pair of spaced apart struts pivotally mounted between the proximate end of the support beam and the base, said struts extending at an obtuse angle in relation to the base when the support structure is in the fully extended position;

a pair of extendable proximate lifting arms mounted between the struts and the base, said proximate lifting arms being disposed to pivotally move the struts between folded and fully extended positions; and a pair of extendable forward lifting arms pivotally mounted between the support beam and the base, said forward lifting arms being disposed to pivotally move between folded and fully extended positions, said forward lifting arms extending in a non-parallel relationship to the struts and the proximate lifting arms when the forward lifting arms are in the fully extended position; and a pipe trough extending longitudinally along the support structure, said pipe trough having opposite parallel side edges and configured to receive the tubular member.

2. The apparatus of claim 1, wherein each of said struts has an inverted L-shaped configuration.

3. The apparatus of claim 1, comprising a plurality of spaced-apart loading arms detachably securable to the pipe trough and extending at an obtuse angle in relation to a side edge of the pipe trough, said loading arms moving the tubular member between the storage rack and the pipe trough.

4. The apparatus of claim 3, wherein each of the loading arms comprises a substantially L-shaped body.

5. The apparatus of claim 4, wherein contact surfaces of the loading arms have a protective coating.

6. The apparatus of claim 1, comprising a plurality of spaced-apart unloading arms detachably securable to the pipe trough and extending at a tangent to a side of the pipe trough, said unloading arms moving the tubular member between the trough and the storage rack.

7. The apparatus of claim 6, wherein each of the unloading arms comprises a substantially planar upper surface.

8. The apparatus of claim 7, said upper surface of each of the unloading arms having a protective coating.

9. The apparatus of claim 1, comprising a means for moving the proximate lifting arms and the forward lifting arms between the folded and fully extended positions.

10. The apparatus of claim 9, said means for moving the proximate lifting arms and the forward lifting arms between the folded and fully extended positions comprises hydraulically movable extendable members.

11. The apparatus of claim 1, comprising a sliding assembly disposed on said support beam and moving the pipe trough along the support beam.

12. The apparatus of claim 1, comprising pivot assemblies mounted between the support structure and the pipe trough and imparting pivotal movement on the pipe trough during loading and unloading of the tubular member to and from the pipe trough.

13. The apparatus of claim 1, said pipe trough having a semicylindrical configuration.

14. The apparatus of claim 1, said forward lifting arms are in direct contact with the support beam and the base.

15. An apparatus for moving a tubular member, comprising:

a base configured to be positioned adjacent a storage rack containing a plurality of tubular members;

an articulated support structure mounted on the base and movable between a folded stationary position and extended positions having a fully extended position, the support structure comprising:

an elongated support beam having a proximate end and a distant forward end, a pair of spaced apart struts pivotally mounted between the proximate end of the support beam and the base, said struts extending at an obtuse angle in relation to the base when the support structure is in the fully extended position;

a pair of extendable proximate lifting arms mounted between the struts and the base, said proximate lifting arms being disposed to pivotally move the struts between the folded and the extended positions; and a pair of extendable forward lifting arms pivotally mounted between the support beam and the base, said forward lifting arms being disposed to pivotally move between folded and extended positions, said forward lifting arms extending in a non-parallel relationship to the struts and the proximate lifting arms when the forward lifting arms are in the fully extended position, and said forward lifting arms are in direct contact with the support beam and the base; and a pipe trough extending longitudinally along the support structure, said pipe trough having opposite parallel side edges and configured to receive the tubular member.

16. The apparatus of claim 15, comprising a means for moving the proximate lifting arms and the forward lifting arms between the folded and extended positions.

17. The apparatus of claim 16, said means for moving the proximate lifting arms and the forward lifting arms between the folded and extended positions comprises hydraulically movable extendable members.

18. The apparatus of claim 15, comprising a plurality of spaced-apart loading arms detachably securable to the pipe trough and extending at an obtuse angle in relation to a side edge of the pipe trough, said loading arms moving the tubular member between the storage rack and the pipe trough.

19. The apparatus of claim 18, wherein each of the loading arms comprises a substantially L-shaped body.

20. The apparatus of claim 19, wherein contact surfaces of the loading arms have a protective coating.

21. The apparatus of claim 15, comprising a plurality of spaced-apart unloading arms detachably securable to the pipe trough and extending at a tangent to a side of the pipe trough, said unloading arms moving the tubular member between the trough and the storage rack.

22. The apparatus of claim 21, wherein each of the unloading arms comprises a substantially planar upper surface.

23. The apparatus of claim 21, said upper surface of each of the unloading arms having a protective coating.

24. The apparatus of claim 15, comprising a sliding assembly disposed on said support beam and moving the pipe trough along the support beam.

25. The apparatus of claim 15, said trough having a semicylindrical configuration.

26. The apparatus of claim 15, wherein each of said struts has an inverted L-shaped configuration.

27. A method of moving a tubular member between a horizontal storage rack and an elevated floor of a platform, the method comprising the steps of:

providing a pipe handling apparatus comprising a base configured to be positioned adjacent a storage rack containing a plurality of tubular members, an articulated support structure mounted on the base and movable between a folded stationary position and a fully extended position reaching to the elevated floor, the support structure comprising an elongated support beam having a proximate end and a distant forward end;

providing a pair of spaced apart struts pivotally mounted between the proximate end of the support beam and the base, and a pipe trough extending longitudinally along the support structure, said pipe trough having opposite parallel side edges and configured to receive the tubular member;

providing a means for elevating the forward end of the support beam in relation to the base such that the struts extend at an obtuse angle in relation to the base at the fully extended position;

providing a pair of extendable proximate lifting arms mounted between the struts and the base, said proximate lifting arms being disposed to pivotally move the struts between folded and fully extended positions;

providing a pair of extendable forward lifting arms pivotally mounted between the support beam and the base, said forward lifting arms being disposed to pivotally move between folded and fully extended positions, said forward lifting arms extending in a non-parallel relationship to the struts and the proximate lifting arms when the forward lifting arms are in the fully extended position;

moving at least one tubular member from the pipe rack into the pipe trough;

moving the support structure upwardly elevating the forward end of the support beam; and delivering the at least one tubular member to the floor of the platform.

28. The method of claim 27, comprising the step of providing a plurality of spaced-apart loading arms detachably securable to the pipe trough and extending at an obtuse angle in relation to a side edge of the pipe trough.

29. The method of claim 28, wherein each of the loading arms comprises a substantially L-shaped body.

30. The method of claim 29, wherein contact surfaces of the loading arms have a protective coating.

31. The method of claim 30, comprising a step of moving a tubular member from the platform floor to the storage rack.

32. The method of claim 31, said step of moving a tubular member from the platform floor comprises: depositing the tubular member into the pipe trough at the floor of the platform, actuating the support structure and lowering the pipe trough adjacent the pipe rack, and then unloading the tubular member from the pipe trough along the unloading arms onto the storage rack.

33. The method of claim 28, actuating said loading arms and moving the at least one tubular member from the storage rack into the pipe trough when moving the at least one tubular member from the pipe rack into the pipe trough.

34. The method of claim 27, comprising a step of providing a plurality of spaced-apart unloading arms detachably securable to the pipe trough and extending at a tangent to a side of the pipe trough.

35. The method of claim 34, wherein each of the unloading arms comprises a substantially planar upper surface.

36. The method of claim 35, said upper surface of each of the unloading arms having a protective coating.

37. The method of claim 27, comprising a step of providing a means for moving the proximate lifting arms and the forward lifting arms between the folded and fully extended positions, said means for moving the proximate lifting arms and the forward lifting arms between the folded and fully extended positions comprising hydraulically movable extendable members.

38. The method of claim 27, comprising a step of providing pivot assemblies mounted between the support beam and the pipe trough and imparting pivotal movement on the trough during loading and unloading of the at least one tubular member to and from the trough.

39. The method of claim 27, said trough having a semicylindrical configuration.

40. The method of claim 27, comprising a step of providing a sliding assembly disposed on said support beam and moving the pipe trough along the support beam when moving the at least one tubular member between a horizontal storage rack and an elevated floor of a platform.

41. The method of claim 27, wherein each of said struts has an inverted L-shaped configuration.

* * * * *